US011084316B2

(12) United States Patent
Maruyama

(10) Patent No.: US 11,084,316 B2
(45) Date of Patent: Aug. 10, 2021

(54) APPLICATOR

(71) Applicant: MITSUBISHI PENCIL COMPANY, LIMITED, Tokyo (JP)

(72) Inventor: Seiichi Maruyama, Fujioka (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 34 days.

(21) Appl. No.: 16/606,749

(22) PCT Filed: May 14, 2018

(86) PCT No.: PCT/JP2018/018545
§ 371 (c)(1),
(2) Date: Oct. 19, 2019

(87) PCT Pub. No.: WO2018/212133
PCT Pub. Date: Nov. 22, 2018

(65) Prior Publication Data

US 2020/0130403 A1 Apr. 30, 2020

(30) Foreign Application Priority Data

May 16, 2017 (JP) ..... JP2017-097309

(51) Int. Cl.
*B43K 8/04* (2006.01)
*B43K 5/02* (2006.01)
(Continued)

(52) U.S. Cl.
CPC ..... *B43K 8/04* (2013.01); *A45D 34/042* (2013.01); *B43K 5/02* (2013.01);
(Continued)

(58) Field of Classification Search
CPC ..... A45D 34/02; A45D 34/04; A45D 40/262; A45D 40/24; A45D 2034/00;
(Continued)

(56) References Cited

U.S. PATENT DOCUMENTS 4,960,340 A 10/1990 Tamiya et al.
6,588,963 B2 * 7/2003 Furukawa ..... B43K 5/18 401/225

(Continued)

FOREIGN PATENT DOCUMENTS

EP 1002478 A1 5/2000
EP 2008640 A1 12/2008

(Continued)

OTHER PUBLICATIONS

English Translation of International Preliminary Report on Patentability corresponding to application No. PCT/JP2018/018545 dated Nov. 19, 2019.

(Continued)

*Primary Examiner* — David J Walczak

(74) *Attorney, Agent, or Firm* — Renner, Otto, Boisselle & Sklar, LLP

(57) ABSTRACT

An applicator in which an applying body consisting of a brush is surely attached to a front barrel to solve a problem that a part of the brush remains stuck inside the front barrel to cause failure of attachment when the applying body is being attached to the front barrel. The applicator includes a front barrel provided on the front end side of a rear barrel, and an applying body formed of a brush with a flange portion at its rear end and arranged inside the front barrel. A receiving part of the flange portion of the applying body and the inner face of the front barrel are in contact with each other in a non-surface contact manner.

5 Claims, 6 Drawing Sheets

(51) Int. Cl.

| | |
|---|---|
| ***B43K 8/06*** | (2006.01) |
| ***A45D 34/04*** | (2006.01) |
| ***A45D 34/00*** | (2006.01) |
| ***A46B 3/00*** | (2006.01) |
| *A46B 3/08* | (2006.01) |

(52) U.S. Cl.
CPC ..... *A45D 2034/002* (2013.01); *A46B 3/08* (2013.01); *B43K 8/06* (2013.01)

(58) Field of Classification Search
CPC ..... A45D 2034/002; A45D 2034/007; B43K 8/04; B43K 8/06; B43K 8/08; B43K 8/12; B43K 8/02; B43K 1/003; B43K 1/006; B43K 5/02; B43K 5/10; A46B 3/00; A46B 3/08; A46B 3/10; A46B 3/12; A46B 7/04
USPC ..... 401/198, 199, 223, 224, 225, 268, 270, 401/276, 283; 15/171, 190, 194, 201

See application file for complete search history.

(56) References Cited

U.S. PATENT DOCUMENTS

| | | | | |
|---|---|---|---|---|
| 8,092,108 | B2 * | 1/2012 | Bainbridge ..... | B43K 11/00 401/171 |
| 8,128,304 | B2 * | 3/2012 | Kurita ..... | B43K 8/04 401/198 |

FOREIGN PATENT DOCUMENTS

| | | | |
|---|---|---|---|
| JP | 54147429 | | 3/1953 |
| JP | H7-4073 | U | 1/1995 |
| JP | 0715379 | | 3/1995 |
| JP | 2000279873 | A | 10/2000 |
| JP | 2003136882 | A | 5/2003 |
| JP | 2009269247 | A | 11/2009 |
| JP | 2011173300 | A | 9/2011 |
| JP | 2015002984 | A | 1/2015 |

OTHER PUBLICATIONS

International Search Report for corresponding Application No. PCT/JP2018/018545, dated Aug. 14, 2018.
Extended European Search Report corresponding to application No. 18803216.3 dated Feb. 3, 2021.

* cited by examiner

APPLICATOR

TECHNICAL FIELD

The present invention relates to an applicator such as a cosmetic tool and a writing implement for applying an application liquid such as writing ink and cosmetic liquid.

BACKGROUND ART

Conventionally, various kinds of applicators, such as brush pens and other writing implements or cosmetic tools, have been used as applicators which apply an application liquid such as a writing ink or a cosmetic liquid onto an application medium such as a paper surface or a skin surface.

In particular, there is an increasing demand for thin drawing, and in order to satisfy this demand, there have been known applicators which have a small-diametric applying body but can reliably lead the application liquid to its tip to achieve favorable coating of the application liquid.

Known examples of such applicators include:

1) an applicator (for example, see Patent Document 1 by the applicant), which has a middle core inserted in a writing part to guide the application liquid, and includes a collector covered by a front barrel and a barrel body to prevent the applicator from leaking the application liquid, the writing part being formed like a hair bundle brush with its rear end formed in a large-diametric flange that is engaged with the inner peripheral surface of the front barrel so as to be prevented from coming off; and 2) a liquid applicator with a brush-like applying body (for example, see Patent Document 2 by the applicant), which includes; an applying body of a brush-like hair bundle; a cylindrical front barrel having the applying body attached on the inner peripheral side; a front side engaging member which is attached on the outer peripheral side of the hair bundle to be engaged with the inner peripheral portion of the front barrel to engage and hold the applying body from the front side; and a rear side engaging part for engaging and holding the applying body from the rear side, wherein: the front side engaging member has a substantially cylindrical outer peripheral restraint part which extends in the front, and rear direction and is formed with a split slot, continuous in the front and rear direction, on the cylindrical side thereof so as to connect the inner peripheral side and the outer, peripheral side and allow the hair bundle to be set from the lateral side; the front side engaging member is formed of an elastic material; and the inner peripheral, surface of the front barrel is provided with a front engaging portion in the form of a tapered step that engages with the front engagement member.

However, in the applicator according to Patent Document 1, when the applicator is assembled, a brush-like writing part made of a hair bundle is inserted from the rear side of the front barrel so as to protrude out from the front barrel while the large-diametric flange at the rear end side is abutted against the entire peripheral engagement step formed inside the front barrel. In this process, however, when the brush-like writing part is inserted from the rear end of the front barrel, tips of part of the hair bundle are caught by the engagement step, being looped back and left behind inside the front barrel. That is, all of the writing part of a brush-like hair bundle cannot be taken out, causing problems such as a defect and a reduction in manufacturability (attachability). Also in the case of the applicator of the Patent Document 2 above, when the brush-like applying body of a hair, bundle is attached to the barrel cylinder by use of the outer peripheral restraint part, there occurs the problem that part of the brush-like applying body of a hair bundle is caught by the front barrel and remains inside the front barrel.

PRIOR ART DOCUMENTS

Patent Documents

[Patent Document 1] Japanese Patent Application Laid-Open No. 2015-2984 (Paragraph 0031, FIGS. 3, 4 and others)

[Patent Document 2] Japanese Patent Application Laid-Open No. 2000-279873 (Claims, FIGS. 1, 2 and others)

SUMMARY OF THE INVENTION

Problems to be Solved by the Invention

The present invention has been devised to solve the above-described problems of the prior art and others, if is therefore an object of the present invention to provide an applicator which can solve the problems such as attachment failure of an applying body of a brush due to part of the brush stuck remaining inside the front barrel when the brush-formed applying body is attached to the front barrel co thereby reliably attach the brush-formed applying body to the front barrel.

Means for Solving the Problems

As a result of intensive studies on the above-mentioned prior art problems, the present inventors have found that, in an applicator, comprising a barrel cylinder reserving an application liquid and an applying body formed of a brush with a flange disposed inside the front end of the barrel cylinder so as to supply the application liquid to the applying body from a storage portion inside the barrel cylinder, specifying the abutment between a receiver of the flange of the applying body and the inner surface of the barrel cylinder in a particular structure is effective to provide the target applicator, and thus completed the present invention.

An applicator according to the present invention comprises: a barrel cylinder storing an application liquid in a storage portion in the rear part thereof; and an applying body, formed of a brush having a flange portion, and arranged in the inferior front part of the barrel cylinder so as to supply the application liquid to the applying body from the storage portion inside the barrel cylinder, and is characterized in that, a receiving part of the flange portion of the applying body and the inner face of the barrel cylinder are in contact with each other in a non-surface contact manner.

More specifically, the applicator includes: a barrel cylinder formed of a rear barrel in which the application liquid is stored and a front barrel provided on the front end side of the rear barrel; and an applying body, formed of a brush with a flange portion at the rear end thereof, and arranged inside the front barrel so as to supply the application liquid to the applying body from the storage portion inside the rear barrel, and is characterized in that a receiving part of the flange portion of the applying body and the inner face of the front barrel are in contact with each other in a non-surface contact manner.

Here, the "rear", referred to in the rear end, indicates the opposite end from the position where the applying body and the cap are located when the barrel cylinder is arranged in the axial direction.

It is preferable that the contact state is formed in a radial arrangement.

It is preferable that the inner face of the barrel cylinder on the front end side of the point at which the receiving part of the flange portion of the applying body abuts the inner face of the front barrel is tapered.

If is preferable that the insertion angle of the applying body at the point where the receiving part of the flange portion of the applying body abuts the inner face of the barrel cylinder and on the front end side ahead of the abutment point is preferably less than 45° with respect, to the axial direction.

It is preferable that the applicator further includes a stirring piece in the storage portion, and the stirring piece has an outside diameter of 40 to 60% of the inside diameter of the storage portion and a length of 10 to 50% of that of the storage portion, and is 0.2 to 1.0 g in weight and formed of a material not containing formaldehyde.

Effect of the Invention

According to the applicator of the present invention, it is possible to provide an applicator, which can solve the problems such as attachment failure of an applying body of a brush due to part of the brush stuck remaining inside the front, barrel, when the brush-formed applying body is attached to the front barrel to thereby reliably attach the brush-formed applying body to the front barrel. In addition, by making the stirring rod elongated, it is possible to improve the function of stirring when the applicator is shaken because the stirring rode is buried in large volume of, or put in contact in large surface with, the cake of deposition when the stirring rod is stored on its side.

MODE FOR CARRYING GUT THE INVENTION

Next, the embodiment of the present invention will be described with reference to the drawings.

Figure 1:
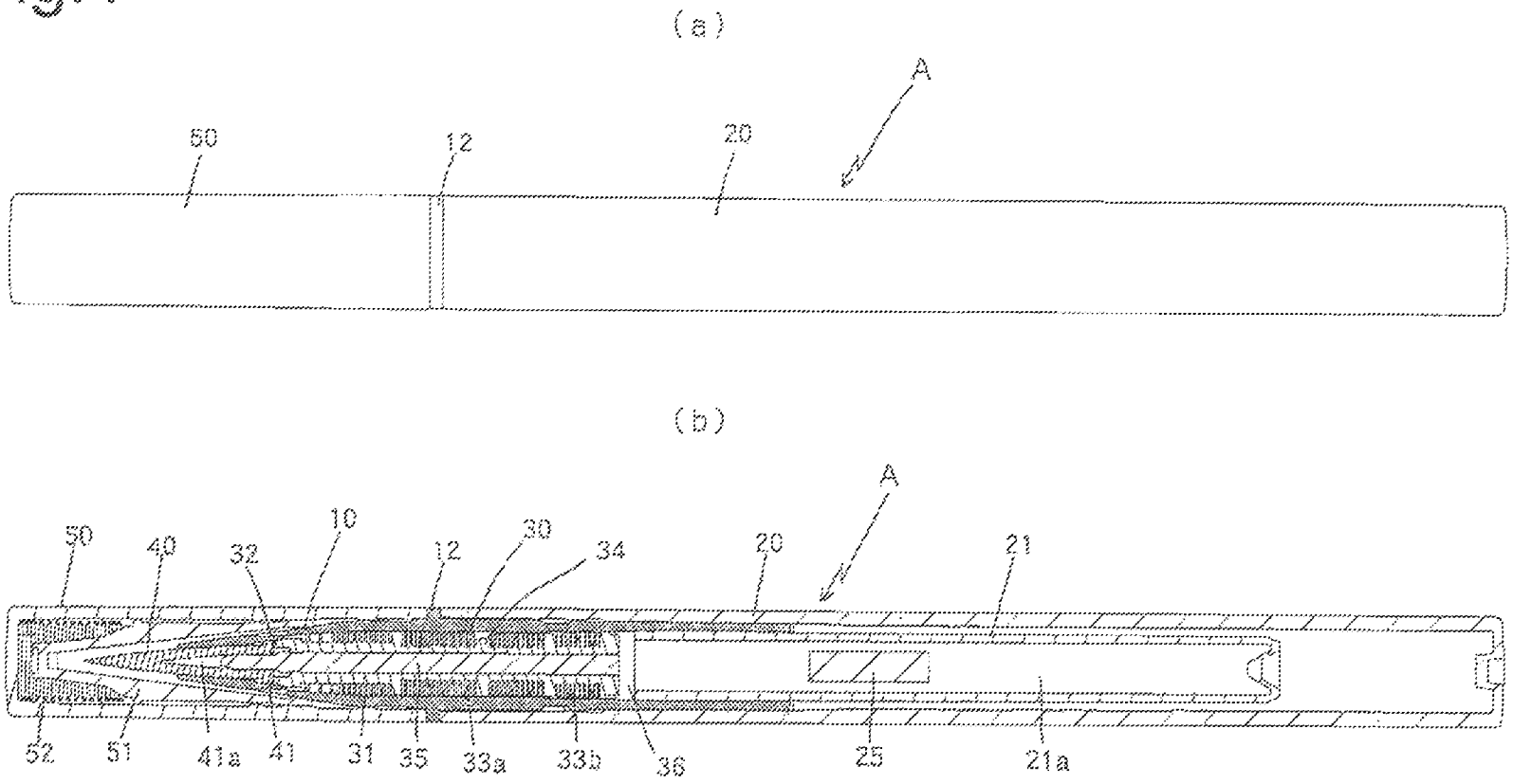
FIG. 1 An example of the embodiment, of the present, invention showing an applicator having a cap attached thereto, (a) a front view and (b) a vertical sectional view.
Figure 2:
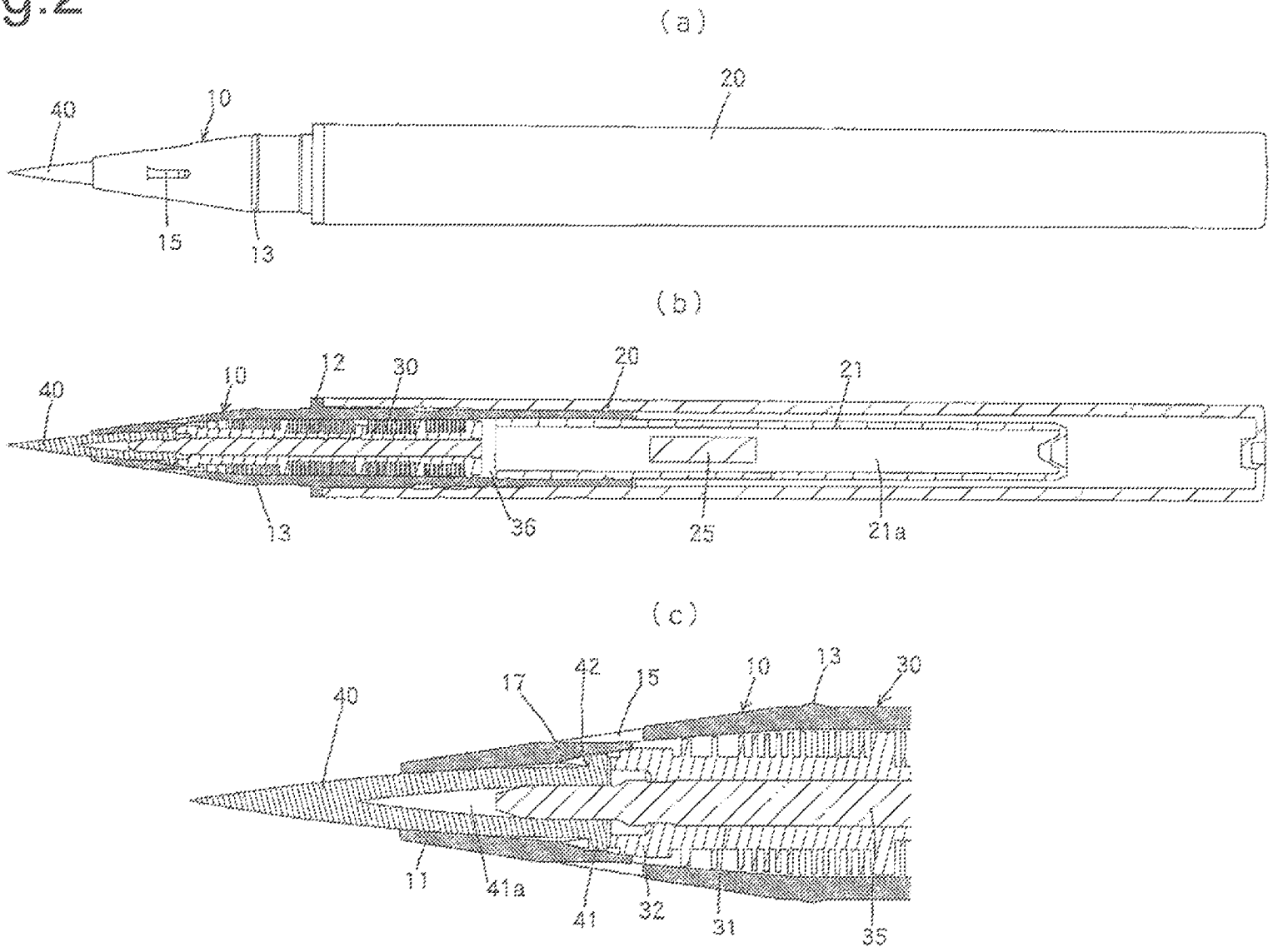
FIG. 2 Explanatory diagrams showing a state of an applicator of the embodiment with a cap thereof removed, (a) a front view, (b) a vertical sectional view and (c) an enlarged vertical sectional view of essential parts.
Figure 3:
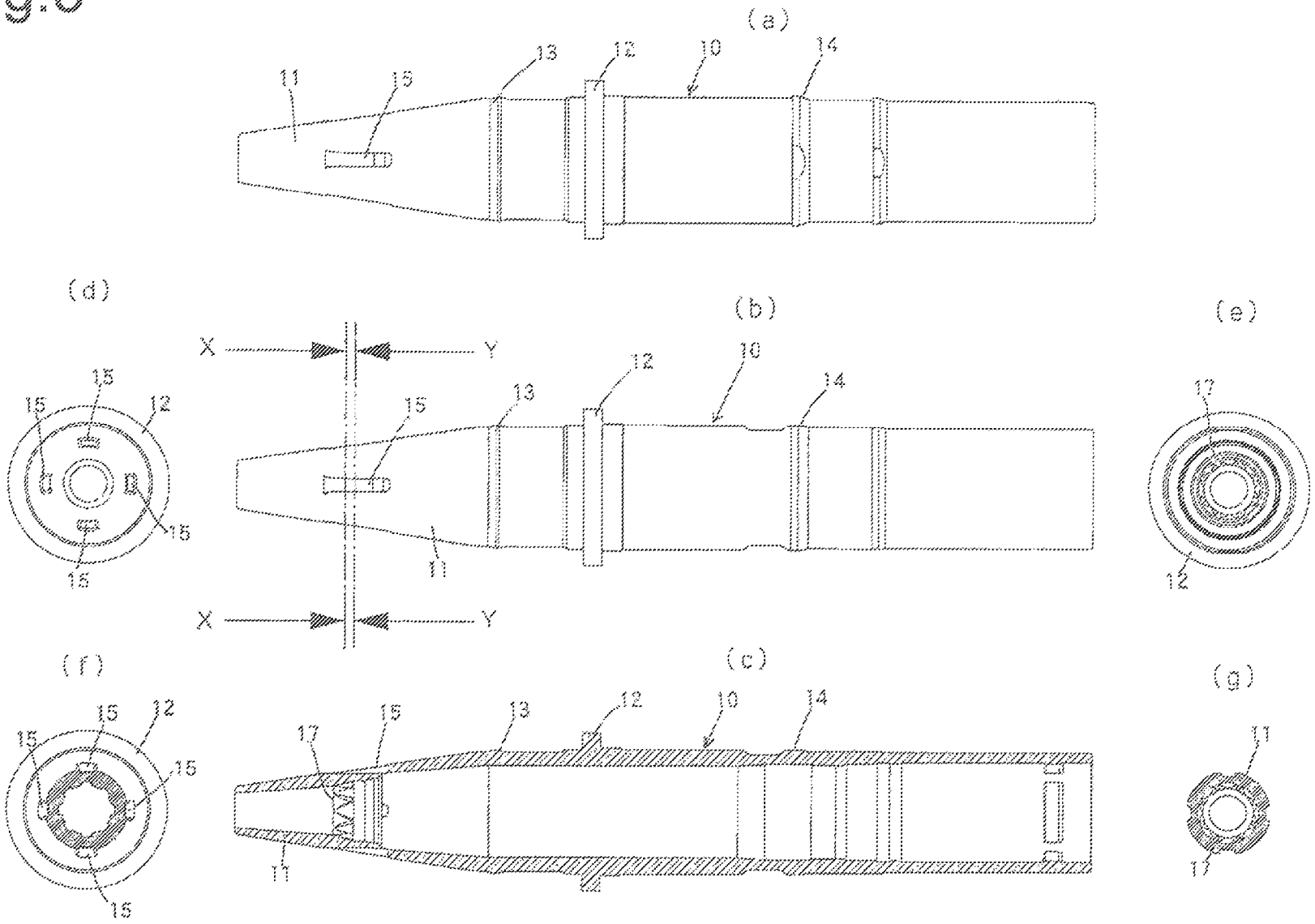
FIG. 3 A front barrel used in an applicator of the embodiment, (a) a plan view, (b) a front view, (c) a vertical, sectional view, id) a left side view, (e) a sectional view taken along & line X-X, (f) a left side view of (c) and (g) a sectional view taken along a line Y-Y.
Figure 4:
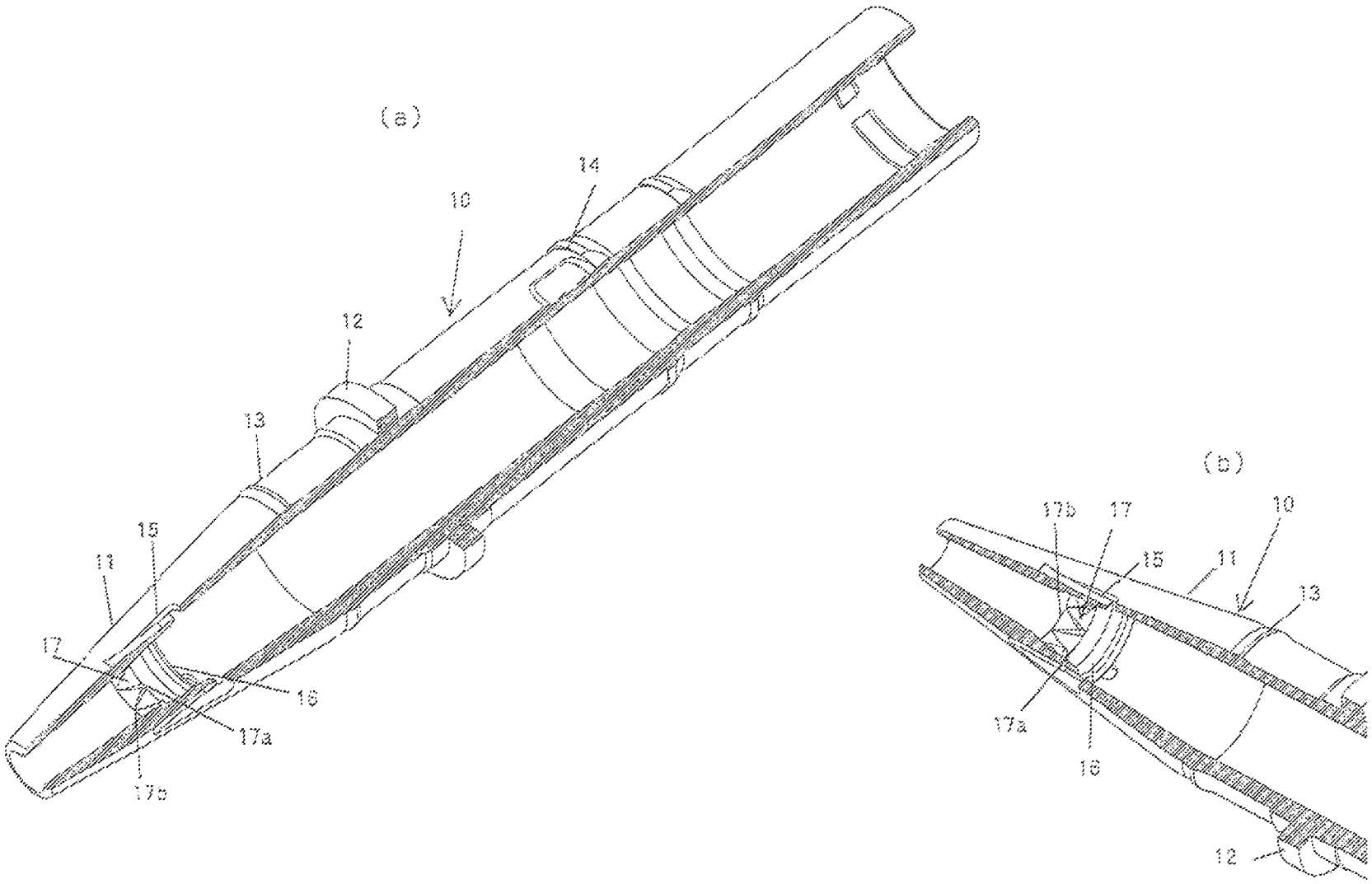
FIG. 4 Explanatory diagrams showing a front barrel used in an applicator of the embodiment, in cutaway view, (a; a perspective cutaway view and (b) a partial perspective cutaway view of the front side of the front barrel.
Figure 5:
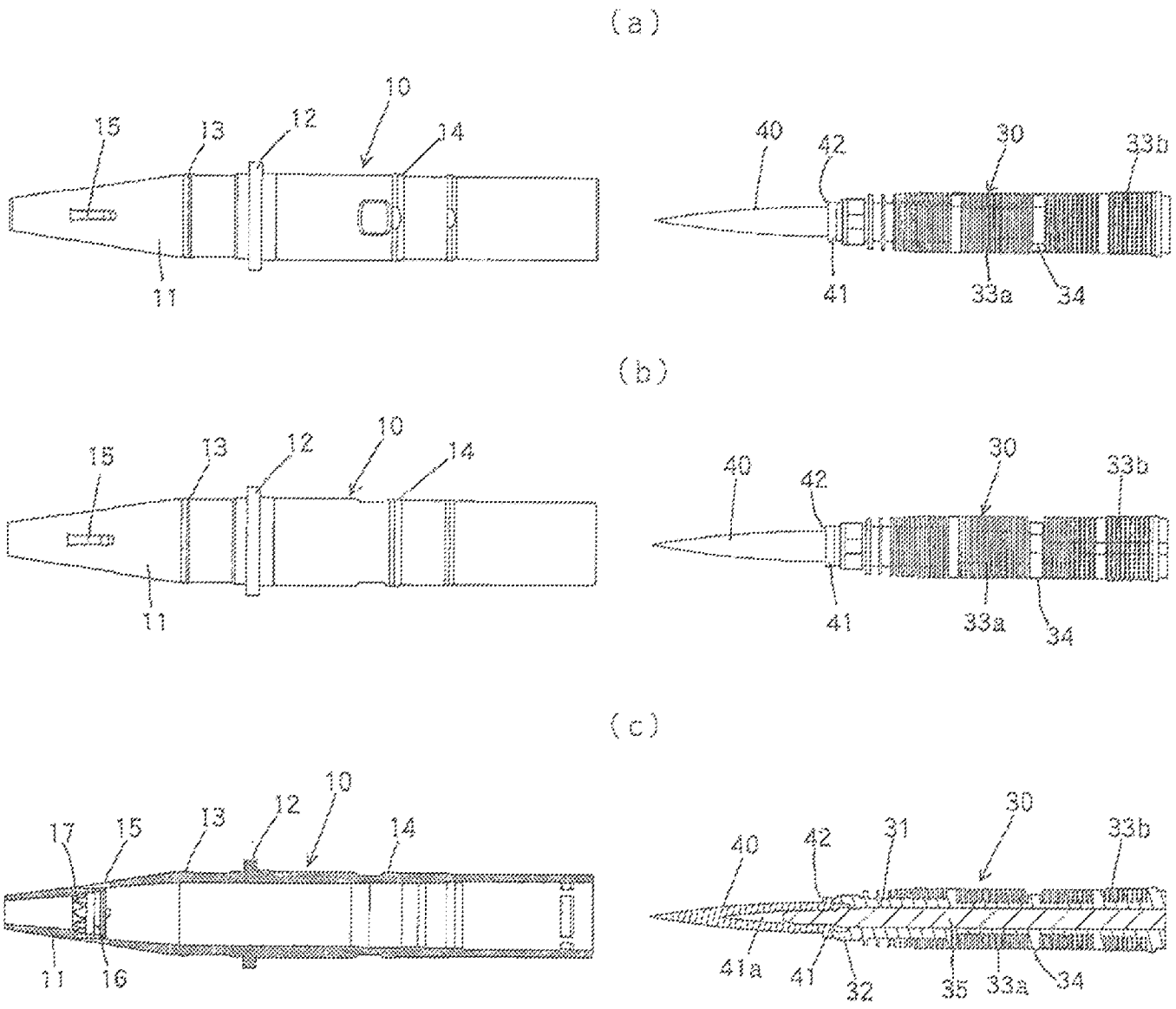
FIG. 5 Explanatory diagrams showing an attachment mode of a front barrel and an applying body used in an applicator of the embodiment, (a) a plan view, (b) a front view and (c) a vertical sectional view.
Figure 6:
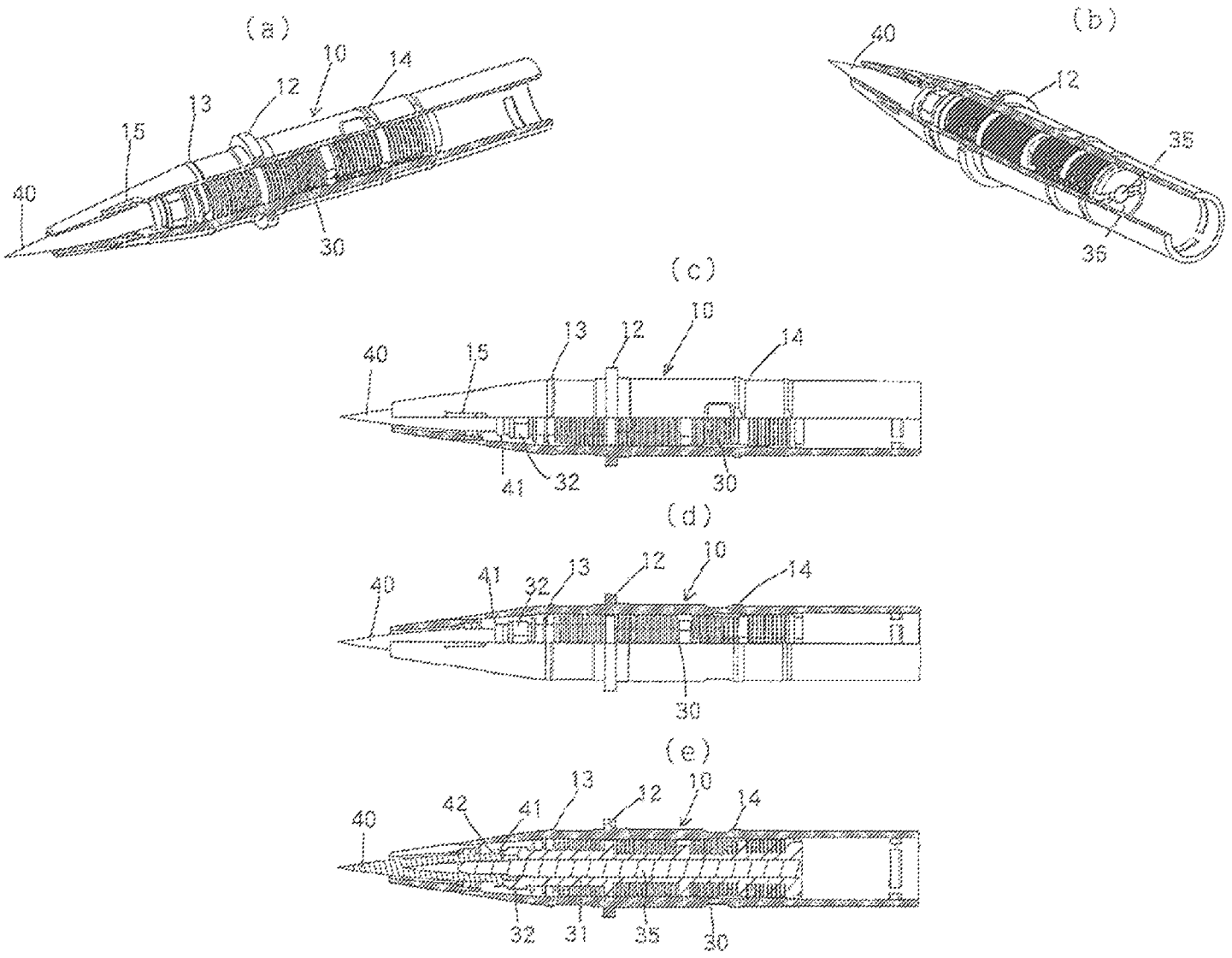
FIG. 6 Explanatory diagrams showing the process of an attachment mode of: a front barrel and an applying body used in an applicator of the embodiment, (a) a perspective cutaway view seen from the front side, (b) a perspective cutaway view seen from the rear, (c) a partially cutaway plan view, (d) a partially cutaway front, view and (e) a vertical sectional view.

FIGS. 1 and 2 are views of one example of an applicator of the embodiment of the present invention, showing a cap-attached state and a cap-removed state, respectively. FIGS. 3 and 4 are views showing a front barrel used for the applicator according to this embodiment. FIGS. 5 and 6 are views showing the attachment mode of a front barrel, and an applying body.

An applicator. A according to the present embodiment is applied to a cosmetic applicator, and is configured of a front barrel 10 forming a barrel cylinder and a rear barrel 20 forming an outer barrel, fitted on the outside periphery of the rear part of the front barrel 10, as shown in FIGS. 1 and 2. Arranged inside the front barrel 10 is a collector member 30 which has a plurality of vanes arranged teeth-like as a comb in the axial direction.

Further, in the rear barrel 20 serving as the outer barrel, a storage portion 21 for storing the application liquid is disposed as an inner barrel. The storage portion 21 is fitted into the rear of the front barrel 10 to communicate with the rear portion of the collector member 30. The storage portion 21 in which the application liquid is stored has a double-pipe structure of the rear barrel 20 forming the outside barrel and a separate body, forming a collector-type cosmetic applicator.

The rear barrel 20 serving as the outer barrel is closed at its rear end, and the storage portion 21 is disposed in a space in the rear barrel 20 between the closed tail end and the rear end of the collector member 30.

The storage portion 21 directly stores the ink (free ink system) without having an absorbent such as silver or the like therein. A stirring piece 25 for stirring the application liquid is also incorporated.

An applying body 40 formed of a tip-tapered brush is projected from the opening of the front end of the front, barrel 10 while a cap 50 covering the applying body 40 is configured to be detachably fitted to the front barrel 10.

As shown in FIGS. 2 and 4, the front barrel 10 has a substantially conical side shape and is tapered. It is preferable that the angle at the front end of the front barrel 10 is substantially equal to the angle of the tip of the applying body 40.

Formed on the outer peripheral side of the front barrel are a tapered front end portion 21, a flange 12 projected in the middle part, radially outwards to position the cap 50 when it is fitted, a rib 13 projected on the front, side of the flange 12 to fit the cap 50 and a rib 14 projected in the rear to fit the rear barrel 20 forming the outer barrel. Further, an air vent hole 15 is formed in front of the rib 23 of the front barrel 10 so as to penetrate the peripheral side from the inside to the outside.

The applying body 40 formed of a brush such as of a hair bundle or the like protrudes out from the front end of the front barrel 10.

The front barrel 10, the rear barrel 20, the storage-port ion 21, the collector member. 30, the cap 50 and the like can be formed as resin molding. Additionally, the stirring piece 25 can use a cylindrical member made of metal, resin or the like.

The collector member 30 is configured to be covered and held by the front barrel 10 and the rear, barrel 20.

The applying body 40 is composed of a brushy (brush-like) tapered brush body made of a hair bundle (fiber bundle) or the like in which a large number of resin fibers, natural fibers and the like are gathered. The applying body 40 has a flange portion 41 having a hollow 41*a* inside the rear end portion of which the diameter is enlarged in a flange shape, and a receiving part 42 formed at the large diametric flange portion 41 abuts the interior of the front barrel 10 in a non-surface contact manner so as to prevent the applying body from coming off.

Specifically, as shown in FIGS. 3 to 6, in the present embodiment, in order to make the receiving part 42 of the flange portion 41 of the applying body 40 abut the inner peripheral surface of the front end portion 11 of the front barrel 10 in a non-surface contact manner instead of an entire surface contact manner, the step portion 16, having a level difference, is configured with an engagement portion 17 which has multiple triangular tops 17*a*, 17*a* . . . formed at predetermined intervals on the inner peripheral surface of the front end portion 11 of the front barrel 10 with bottoms 17*b*, 17*b* . . . connected along the circumference, so that the receiving part 42 of the flange portion 41 of the applying body 40 makes point contacts with the step portion 16 without creating surface contact. Thus, when the application tool is completed (when assembled), the applying body is prevented from coming off as the receiving part 42 of the flange portion 41 of the applying body 40 abuts (engages) the engagement portion 17 in a non-surface contact manner.

Arranged inside the hollow of the tapered front barrel 10 behind the applying body 40 is the collector member 30 of a bellows-shape. A center core 35 is disposed penetrating through a hollow portion 31 of the collector member 30. The center core 35 is composed of a capillary member such as a resin fiber bundle, a natural fiber bundle and a resin porous body.

This center core 35 does not protrude into a storage space 21*a* in the storage portion 21 beyond the rear end of the collector member 30 (see FIGS. 1 and 2). The rear endface of the center core 35 is substantially flush with the rear endface of the collector member 30. By making the center core 35 flush, the rear, end of the center core 35 does not protrude into the storage space 21*a* so that the volume in the storage space 21*a* can be secured. In addition, since the rear end of the center core 35 does not protrude into the storage space 21*a*, when a stirring piece 25 is provided in the storage space 21*a*, the stirring piece 25 will neither collide with nor deform the center core 35 even if the stirring piece 25 moves within the storage space 21*a*, thus making it possible to sufficiently impregnate the center core with the application liquid. Further, as described later, the center core 35 is configured so that its tip is disposed in the hollow 41*a* of the applying body 40 so as to efficiently feed the application liquid from the storage space 21*a* to the applying body 40 via the center-core 35.

Formed in the front part of the collector member 30 with respect to the axial direction thereof is a cup-like part 32. Formed in the collector member 30 from the front to the middle thereof with respect to the axial direction are a front side temporary storage section 33*a* and a rear side temporary storage section 33*b*, each having a plurality of comb-tooth fins spaced from each other.

As the center core 33 is provided in the collector member 30, in the embodiment; a wall portion is formed around the axial center of the collector member 30, and the hollow portion 31 is formed inside the wall portion, penetrating the center of the wall. Provided on the outer periphery of the wall portion defining the hollow portion 31 are fins for temporarily storing the application liquid (front, temporary storage section 33*a* and rear temporary storage section 33*b*), which extend radially outwards, forming multiple sheet-like vanes. In the wall portion, through-holes, through which the application liquid can flow between the hollow portion 31 and the gaps between the fins, are formed along the radial direction from the outer periphery to the inner periphery of the hollow portion 31.

Furthermore, in the collector member 30, the above-mentioned longitudinal ink grooves (slits) for conducting the application liquid into the fin gaps are formed from the front side temporary storage section 33*a* to the rear side temporary storage section 33*b*, and exposed at the rear end (so as to be exposed to the storage space 21*a* of the storage portion 21). In addition, thick support walls 34 that abut the inner surface of the front barrel 10, for partitioning, are appropriately arranged at positions every multiple number of fins in the front temporary storage section 33*a* and the rear temporary storage section 33*b*.

Specifically, the number of fins in the front side temporary storage section 33*a* and the rear side temporary storage section 33*b* is 40 to 60 in total, among which the proportion of the front side temporary storage section 33*a* is 75 to 85% whereas that of the rear side temporary storage section 33*b* is 15 to 2.5%. The distance between the fins can be set at 0.15 to 0.3 mm.

In the present embodiment, the storage capacity of the storage space 21*a* is 0.7 (ml). The outside diameter of the storage portion 21 may be set at 8.5 (mm), and the diameter of the collector, member 30 may be set at 6.0 (mm).

In the cap 30, a cup-shaped inner cap 51 for keeping the applying body 40 airtight is disposed so as to be movable back and forth, and a spring 52 for urging the inner cap 51 rearward is provided.

The applicator A of the present embodiment has a double structure of the storage portion 21 having an inside diameter of 4.5 (mm) and the rear barrel 20 having an outside diameter, of (10 mm) serving as the outer barrel. Provision of the double structure is aimed at isolating the rear barrel 20 for decoration so as to provide a design optimized for printing and the like.

The stirring piece 25 has a cylindrical shape, and the outside diameter thereof is 40 to 60% of the inside diameter of the storage portion 21 (storage space 21*a*). The length of the stirring piece 25 is 10 to 50% of the length of the storage portion 21 (storage space 21*a*). The weight of the stirring piece 25 is 0.2 to 1.0 g. The stirring piece is preferably formed of a highly anticorrosive material or a material not containing formaldehyde. The material not containing formaldehyde means that it contains less than 500 ppm, preferably less than 200 ppm of free formaldehyde based on the total weight of the stirring piece. Examples include metals such as stainless steel, non-ferrous metals such as aluminum, synthetic resins such as polypropylene substantially free of acetal, phenol, urea, melamine and the like, viscoelastic materials such as olefin elastomers and silicone rubbers, and mixed materials of metal powder and synthetic resin. The content of formaldehyde should be measured according to the VDA 275 test method.

The specific weight of the stirring piece 25 is preferably higher than the specific weight of the cosmetic fluid in the storage portion 21, and more preferably, 6.0 or greater.

Since the outside diameter and length of the stirring piece 25 are specified as described above, the stirring piece 25 can be formed to have a large length accommodated in the storage portion (storage portion) 21, whereby it is possible to increase weight by length even with a small diameter that does not block air movement. Therefore, it is easier to make a product smaller in diameter and in a double structure than when using a stirring ball. However, when the product with a thin stirring rod is stored on its side, the thin stirring rod may be buried in large volume of, or put in contact in large surface area with, the cake of deposition of the application liquid. Therefore, it is necessary to make the stirring piece heavier than the ball in order to enhance the function of stirring when shaking. For this purpose, a large stirring piece 25 can secure an appropriate weight.

Arranged in the rear of the applicator body 40 or the applicator according to the present embodiment is the collector member 30 functioning as an air vent, mechanism, in which the application liquid flows from the storage portion 21 through the center core 3*b* and the slits. Since external air flows in and out of the air space around the collector member. 30 through the air vent hole 15 of the front barrel 10, the external air can circulate as appropriate in the collector member 30 even if the pressure inside the storage portion 21 increases or decreases. Therefore, the collector member 30 can provide an adequate function of the air vent mechanism.

In addition, a shielding plate 36 is provided between the storage space 21*a* of the storage portion 21 and the air vent mechanism of the collector member 30.

The application liquid to be stored in the storage portion 21 of the rear barrel 20 is an application liquid suitable for the use of the applicator or the like. When the applicator, is a writing implement such as a maker pen and a brush writing pen, an aqueous ink composition for writing implements, an oil-based ink composition for writing implements, a black ink and the like can be used. When the applicator is a cosmetic fluid applicator, a correction fluid applicator, a chemical solution applicator, a coating applicator, etc., application liquids, such as a cosmetics liquid, a correction liquid, a medical solution, a coating fluid and the like can be used.

The application liquid of the present embodiment is composed of a liquid cosmetic composition, and contains at least 0.05 to 30% by mass of a coloring material, 0 to 20% by mass of a water-soluble organic solvent, 2 to 20% by mass of a film forming agent (solid content equivalent), and water, preservative and others.

As a coloring material to be used, since the present embodiment has a suitable stirring piece 25, at least one bind of titanium oxide, iron oxide, iron blue pigment, ultramarine blue pigment and the like, which easily sediments can be used. Titanium oxide has a specific weight of 3.8 to 4.2 and preferably has a particle size of 200 to 500 nm in the cosmetic fluid; iron oxide has a specific weight of 3.6 to 5.5 and preferably has a particle size of 90 to 600 nm in the cosmetic fluid; iron blue pigment has a specific weight of 1.3 to 1.9 and preferably has a particle size of 80 to 300 nm in the cosmetic fluid; ultramarine blue pigment has a specific weight of 1.8 to 1.9 and preferably has a particle size of 300 to 600 nm in the cosmetic fluid. Here, in the present invention, "particle size" is the measurement obtained by measuring the liquid cosmetic (25° C.) by means of a particle size measuring device FPAR-1000 (manufactured by Otsuka Electronics Co., Ltd.) using the dynamic light scattering method.

Examples of other coloring materials that can be used, include: organic pigments such as Blue No. 1 A1 lake, Red No. 202, Red No. 220, Red No. 226, Red No. 228, blue No. 201, Blue No. 204, Blue No. 404, Yellow No. 401, Yellow No. 205, Yellow No. 4 A1 lake, Yellow No. 203 A1 lake, Red No. 104 A1 lake, carbon black and carmine; acid dyes such as Red No. 2, Red No. 3 (FD&C Red No. 3), Red 40 No. (FD&C Red No. 40), Red No. 102, Red No. 104 (D&C Red No. 28), Red No. 105, Red No. 106, Red No. 201 (DM: Red No. 6), Red No. 202 (D&C Red No. 7), Red 203, Red 205, Red 227 (D&C Red No. 33), Red 230-1 (D&C Red No. 22), Red No. 401, Red No. 402, Red No. 504 (FD&C Red No. 4), Orange No. 205 (D&C Orange No. 4), Orange No. 402, Yellow No. 4 (FD&C Yellow No. 5), Yellow No. 5 (FD&C Yellow No. 6), Yellow No. 203 (D&C Yellow No. 10), Yellow No. 402, Yellow No. 403-1 (Ext. D&C Yellow No. 7), Yellow No. 406, Yellow No. 407, Green No. 3 (FD&C Green No. 3), Green No. 201, Green No. 402, Blue No. 2 (FD&C Blue No. 1), Blue No. 2 (FD&C Blue No. 2), Blue No. 203, Blue No. 205 (D&C Blue No. 4), Blue No. 403, Blue No. 404, Brown No. 201 (D&C Brown No. 1), Purple No. 401 (Ext. D&C violet No. 2) and black No. 401. At least one selected from these and the aforementioned inorganic pigments such as titanium oxide, iron oxide, iron blue pigment and ultramarine blue pigment, can be considered. There is no particular limitation as long as it is a coloring material that is used for aqueous cosmetics.

The content of the coloring material is preferably 0.05 to 30% of the total amount of the liquid cosmetic, more preferably 0.1 to 20%, from the viewpoint of color developability, suitable viscosity and smooth dischargeability with an aqueous cosmetic applicator provided with an applying body.

The water-soluble organic solvent that can be used is not particularly limited as long as it is generally used in cosmetics, and any solvent can be used. For example, ethanol, isopropanol, phenoxyethanol and the like can be mentioned.

The content of the water-soluble organic solvent is preferably 0 to 201, more preferably 8 to 15%, based on the total amount of the liquid cosmetic.

As the film-forming agent that can be used is, for example, an emulsion resin of a copolymer selected from one or more monomers of acrylic acid, methacrylic acid, their alkyl esters and derivatives, styrene and vinyl acetate can be mentioned.

The content of the film-forming agent (emulsion resin) is preferably 2 to 15%, more preferably 2 to 10%, in terms of solid content (resin content) based on the total amount of the liquid cosmetic.

The used liquid cosmetic is dissolved in water (including purified water, distilled water, ion-exchanged water, pure water, ultrapure water, etc.) as a solvent. The water content is the remaining part other than the above-mentioned components and the optional components described below.

Further, the liquid cosmetic composition to be used may contain, in addition to the above-mentioned components and the like, optional components used for ordinary liquid cosmetic compositions. Specifically, preservatives, antioxidants, neutralizing agents, ultraviolet, light absorbers, chelating agents, moisturizers, cosmetic ingredients, fragrances, viscosity modifiers, etc. may be contained in appropriate amounts without impairing the effects of the present invention.

The used liquid cosmetic composition preferably has a viscosity ranging from 2 to 9 mPa·s, in terms of the measurement at a temperature of 25° C. and at a shear rate of 76.6 $S^{-1}$ by an ELD viscometer, preferably having a surface tension of 34 mN/m or above, from the viewpoint of smoothly discharging the application liquid from the applicator and exhibiting fine coating performance.

The thus configured applicator A of this embodiment has the following structure in terms of assembly. Specifically, the front barrel 10, the rear barrel 20 to be the outer barrel, the collector member 30, the applying body 40 and the cap 50, which are structured as described above, are assembled as follows, into an applicator, of the present embodiment.

As shown in FIG. 5, the flange 41 having the hollow 41*a* of the applying body 40 is attached to the front endface of the collector member 30 from which the tip of the center core 35 protrudes. When the collector member 30 having the center 33 with the applying body 40 attached is inserted (fitted) forward from the opening on the rear side of the front, barrel 10 as shown in FIG. 6, the receiving part 42 of the flange portion 41 of the applying body 40 abuts against the non-surface contact engagement portion 17 formed on the inner peripheral surface of the front barrel 10 (creating non-surface contact abutment) while the outer peripheral side of the flange portion 41 is put in contact with the inner peripheral, surface of the front barrel 10 to prevent the applying body from coming off, as shown in FIG. 2(*c*). Further, the rear, temporary storage section 33*b* has a larger outside diameter than the front temporary storage section 33*a*, and arranged so as to be adjacent to the inner wall surface of the front barrel 10 as shown in FIG. 1 and others. Next, the rear barrel 20 serving as the outer barrel having the storage portion 21 containing the application liquid is fixed by fitting to the front barrel 10 to which the applying body 40 and the collector member 30 etc. has been attached. Then, as shown in FIG. 1, attaching the cap 50 completes the applicator.

According to the applicator A thus obtained, the applicator can be easily assembled, and the application liquid stored in the storage portion 21 in the rear barrel 20 to be the outer barrel can be efficiently supplied via the center core 35 in the collector member 30 to the applying body 40. Further, in this applicator A, in order to make the receiving part 42 of the flange portion 41 of the applying body 40 abut the tapered inner peripheral surface of the front end portion 11 of the front barrel 10 in a non-surface contact manner, e.g., in a point contact manner, instead of an entire surface contact manner, the engagement portion 17 which has multiple triangular tops 17*a*, 17*a* . . . with bottoms 17*b*, 17*b* . . . are formed continuously along the circumference, so that the applying body 40 abuts (engages) the engagement portion 17 at the receiving part 42 of the flange portion 41, in non-surface contact (point contact) so as to be prevented from coming off. Thus, in contrast to the configuration of the conventional applicator in which the receiving part of the flange of the applying body is put in surface contact around the whole circumference with the inner peripheral surface of the front barrel, provision of the non-surface contact structure between the receiving part 42 of the flange portion 41 of the applying body 40 and the non-surface contact forming engagement portion 17 provided on the tapered inner peripheral surface at front end portion 11 of the front barrel 10, makes it possible to provide an applicator which can surely attach the brushy applying body into the front barrel while reliably preventing the brush part of a hair bundle or the like from being partially caught, looped and left behind inside the front barrel when the applying body 40 of the brush part is assembled into the front barrel 10.

As long as the abutment between the receiving part 42 of the flange portion 41 of the applying body 40 and the inner surface of the front barrel 10 forms a non-surface contact state, the shape and geometrical arrangement of the engagement portion 17 that forms a non-surface contact structure on the inner peripheral surface in the front barrel 10 are not particularly limited, and may be formed with a radial arrangement, an uneven arrangement of points, an annular arrangement or others.

Further, it is preferable that the inner surface of the barrel cylinder on the front end aide of the point at which the receiving part 42 of the flange portion 41 of the applying body 40 abuts the inner surface of the front, barrel 10 is tapered, in view of insertability of the applying body 40 composed of a brush.

Furthermore, the insertion angle of the applying body 40 at the point where the receiving part 42 of the flange portion 41 of the applying body 40 abuts the inner surface of the barrel cylinder and on the front end side ahead of the abutment point is preferably less than 45° with respect to the axial direction, in view of securing more stable insertability of the applying body 40 composed of a brush.

The applicator of the present invention is not limited to the above-described embodiment and the like, and various changes can be made therein without departing from the spirit and scope of the invention.

The technical idea of the applicator according to the present invention resides in an applicator comprising:

a barrel cylinder storing an application liquid in a storage portion in the rear part thereof; and an applying body, formed of a brush having a flange portion, and arranged in the interior front part of the barrel cylinder so as to supply the application liquid to the applying body from the storage portion inside the barrel cylinder, wherein a receiving part of the flange portion of the applying body and the inner face of the barrel, cylinder are in contact with each other in a non-surface contact manner. Accordingly, the above embodiment provides an applicator using a free-ink collector member 30 as a mechanism for supplying an application liquid to the applying body 40, but the application liquid supply mechanism for the applicator may use a valve type or a sliver type that holds an application liquid absorbed in a sliver.

EXAMPLES

The present invention will next be described in more detail by way of examples, which should not be construed as limiting the invention thereto.

Example 1

An applicator conforming to the following constitution and FIGS. 1 to 6 and an application liquid of the following composition were used.

(Configuration of Front Barrel 10)

made of polypropylene, length: 50 mm, tapered front end length: 15 mm, front side opening diameter: 2 mm, rear end opening diameter: 6 mm (Configuration of Rear Barrel 20, Stirring Piece 25, Collector Member 30 and Core 35)

Rear barrel 20: made of polypropylene resin, outside diameter: 10 mm, length: 90 mm Stirring piece 25: weight: 0.40 g, made of stainless steel, shape: cylindrical ϕ2.5 mm×length 10 mm Collector member 30: The number of fins of the front side temporary storage section 33*a* and the rear side temporary storage section 33*b* is 47 in total, the proportion of the front, side temporary storage section 33*a* was 80%, the proportion of the rear side temporary storage section 33*b* was 20%, and the distance between the fins was 0.15 to 0.3 mm.

Storage capacity of the storage space 21*a*: 0.7 (ml), outside diameter, of the storage portion 21: 6.5 (mm), inside diameter: 4.5 (mm), outside diameter of the collector member 30: 6.0 mm).

Core 33: polyester porous body, porosity of 40 to 60%, diameter 1.8 mm×length 35 mm (Configuration of Applicator 40)

An applying body composed of about 300 to 330 fibers of polybutylene terephthalate resin as a raw material, and having a length of 13 mm, a diameter of 100 to 130 μm with a flange portion having a diameter of 4 mm was used.

(Composition of Application Liquid)

As an application liquid, a liquid cosmetic (total 100% by mass) having the following composition was used.

Coloring material (carbon black, iron oxide, other inorganic and organic pigments) 0.01 to 30% by mass Film forming agent; (acrylic polymer, urethane polymer) 1 to 50% by mass Preservative (parabens, phenoxyethanol, other cosmetic preservatives) 0.001 to 5% by mass Water-soluble organic solvent (1.3 butylene glycol) 0.1 to 20% by mass Water (solvent): Ion-exchanged water for remaining The viscosity and the surface tension, measured at a shear rate of 76.6 $S^{-1}$ by an ELD viscometer at a temperature of 25° C. were 1 to 10 mPa·s and 30 to 50 mN/m.

In the applicator using the parts of: this example 1, when the applying body formed of a brush was attached to the front barrel, it was confirmed that an applicator that enables perfect fitting of the applying body of a brush to the front without causing any problem such as the partial remaining of the brush inside the front barrel due to stagnation, mounting failures and the like was assembled. Moreover, when this applicator: was used as an eyeliner, if was possible to apply thinly to skin etc.

INDUSTRIAL APPLICABILITY

The applicator of the present invention can be used as a writing pen when it is applied to the writing implement. When used as an application tool, this applicator can be preferably applied to correction liquid applicators, chemical liquid applicators, paint applicator and the like, in addition to cosmetic liquid applicators such as eyeliner and eyebrow.

DESCRIPTION OF REFERENCE NUMERALS

A applicator
10 front barrel
20 rear barrel
25 stirring piece
30 collector member
35 center core
40 applying body
41 flange portion
42 receiving pare
50 cap

The invention claimed is:

1. An applicator comprising:

a barrel cylinder storing an application liquid in a storage portion in a rear part thereof; and an applying body, formed of a brush having a flange portion arranged in an interior front part of the barrel cylinder so as to supply the application liquid to the applying body from the storage portion inside the barrel cylinder, wherein the flange portion of the applying body includes a receiving part; and wherein an inner peripheral surface of a front end of the interior front part of the barrel cylinder includes a step portion having a level difference and configured with an engagement portion having multiple triangular tops formed at predetermined intervals on the inner peripheral surface of the front end of the interior front part of the barrel cylinder, and bottoms connected along a circumference of the engagement portion such that the receiving part of the flange portion makes point contacts with the step portion on the inner peripheral surface of the front end of the interior front part of the barrel cylinder.

2. The applicator according to claim 1, wherein the engagement portion is formed with a radial arrangement.

3. The applicator according to claim 1, wherein the inner face of the barrel cylinder on a front end side of a point at which the receiving part of the flange portion of the applying body abuts an inner face of the front barrel is tapered.

4. The applicator according to claim 1, wherein an insertion angle of the applying body at a point where the receiving part of the flange portion of the applying body abuts an inner face of the barrel cylinder and on a front end side ahead of an abutment point is less than 45° with respect to an axial direction.

5. The applicator according to claim 1, wherein the applying body is assembled into the interior front part of the barrel cylinder.

* * * * *